US009500191B2

(12) United States Patent
Scarpinato et al.

(10) Patent No.: US 9,500,191 B2
(45) Date of Patent: Nov. 22, 2016

(54) COMPRESSOR SYSTEM INCLUDING A FLOW AND TEMPERATURE CONTROL DEVICE

(75) Inventors: Paul A. Scarpinato, Clemmons, NC (US); Larry R. Stutts, Mooresville, NC (US); Sudhir Sreedharan, Chennai (IN)

(73) Assignee: Ingersoll-Rand Company, Davidson, NC (US)

( * ) Notice: Subject to any disclaimer, the term of this patent is extended or adjusted under 35 U.S.C. 154(b) by 858 days.

(21) Appl. No.: 13/580,292

(22) PCT Filed: Jan. 22, 2010

(86) PCT No.: PCT/US2010/021732
§ 371 (c)(1),
(2), (4) Date: Aug. 21, 2012

(87) PCT Pub. No.: WO2011/090482
PCT Pub. Date: Jul. 28, 2011

(65) Prior Publication Data
US 2012/0321486 A1 Dec. 20, 2012

(51) Int. Cl.
*F04B 39/02* (2006.01)
*F01M 5/00* (2006.01)
(Continued)

(52) U.S. Cl.
CPC ..... *F04B 39/0207* (2013.01); *F01M 5/007* (2013.01); *F04B 39/02* (2013.01);
(Continued)

(58) Field of Classification Search
CPC ..... F04B 39/0207; F04B 39/02; F04B 53/18; F04C 15/0088; F04C 15/0092;
(Continued)

(56) References Cited

U.S. PATENT DOCUMENTS 2,480,676 A 8/1949 Shaw
2,540,628 A * 2/1951 Miller ..... 236/34.5
(Continued)

FOREIGN PATENT DOCUMENTS

CN 1164624 11/1997
CN 2555491 6/2003
(Continued)

OTHER PUBLICATIONS

International Search Report dated Apr. 25, 2012 of PCT/US2010/021732, filed Jan. 22, 2010.
(Continued)

*Primary Examiner* — Bryan Lettman
(74) *Attorney, Agent, or Firm* — Taft, Stettinius & Hollister LLP

(57) ABSTRACT

A compressor system including a lubricant inlet compresses a gas and discharges a mixed flow of compressed gas and lubricant. A valve housing includes a hot and a cooled lubricant inlet, and a lubricant outlet. A sleeve is disposed within the valve housing and is movable between a first and a second position. The sleeve defines a mixing chamber and includes a first aperture with the hot lubricant inlet and a second aperture with the cooled lubricant inlet. The hot and cooled lubricant mix in the mixing chamber are directed to the lubricant inlet of the compressor. A thermal element is positioned to sense a temperature and moves the sleeve in response. The movement of the sleeve varies the amount of hot lubricant admitted through the first aperture and varies the amount of cooled lubricant admitted through the second aperture to control a lubricant temperature.

24 Claims, 4 Drawing Sheets

(51) Int. Cl.

| | |
|---|---|
| ***F04B 39/06*** | (2006.01) |
| ***F04B 49/06*** | (2006.01) |
| ***F04B 53/18*** | (2006.01) |
| ***F04C 18/16*** | (2006.01) |
| ***F04C 29/02*** | (2006.01) |
| ***F04C 29/04*** | (2006.01) |

(52) U.S. Cl.

CPC ..... *F04B 39/06* (2013.01); *F04B 49/06* (2013.01); *F04B 53/18* (2013.01); *F04C 18/16* (2013.01); *F04C 29/021* (2013.01); *F04C 29/042* (2013.01); *F04C 2240/81* (2013.01); *F04C 2270/19* (2013.01); *F04C 2270/44* (2013.01)

(58) Field of Classification Search

CPC ..... F04C 29/02; F04C 29/021; F16K 11/0716; F16K 19/00; F01P 7/16; F16H 57/0413; F01M 5/007; F01M 5/005; G05D 23/022; G05D 23/13; G05D 23/1306; G05D 23/1858

USPC ..... 417/228; 187/6.22; 236/12.2, 12.11, 236/12.18, 12.23

See application file for complete search history.

(56) References Cited

U.S. PATENT DOCUMENTS

| | | | | |
|---|---|---|---|---|
| 2,540,629 | A | 2/1951 | Miller | |
| 2,603,420 | A * | 7/1952 | Tacchi | 236/12.18 |
| 2,975,973 | A | 3/1961 | Carroll | |
| 2,988,280 | A | 6/1961 | Kimm et al. | |
| 3,721,386 | A * | 3/1973 | Brick et al. | 236/12.12 |
| 4,024,909 | A | 5/1977 | Hofmann, Jr. | |
| 4,190,198 | A | 2/1980 | Casuga et al. | |
| 4,195,774 | A | 4/1980 | Warner | |
| 4,398,662 | A | 8/1983 | Costello | |
| 4,431,390 | A | 2/1984 | Hart | |
| 4,488,680 | A | 12/1984 | Itoh | |
| 4,537,346 | A | 8/1985 | Duprez | |
| 5,094,426 | A | 3/1992 | Zajac | |
| 5,318,151 | A * | 6/1994 | Hood et al. | 184/6.1 |
| 5,791,557 | A | 8/1998 | Kunze | |
| 5,803,354 | A * | 9/1998 | Benedict | 236/12.2 |
| 5,819,692 | A * | 10/1998 | Schafer | F01P 3/08 123/41.35 |
| 5,890,515 | A | 4/1999 | Spiess et al. | |
| 5,984,195 | A | 11/1999 | Benedict | |
| 5,988,514 | A | 11/1999 | Huang | |
| 6,405,932 | B1 | 6/2002 | Palmer | |
| 6,457,652 | B1 | 10/2002 | Fukamachi et al. | |
| 6,575,707 | B2 | 6/2003 | Matt et al. | |
| 6,719,546 | B2 | 4/2004 | Foerster | |
| 6,863,221 | B2 | 3/2005 | Colas et al. | |
| 6,915,958 | B2 | 7/2005 | Colas et al. | |
| 7,094,037 | B2 * | 8/2006 | Nakamura et al. | 417/63 |
| 7,114,913 | B2 | 10/2006 | Coker | |
| 7,299,994 | B2 | 11/2007 | Brown et al. | |
| 7,490,662 | B2 | 2/2009 | Eliades et al. | |
| 7,762,789 | B2 * | 7/2010 | Scarpinato | 417/228 |
| 2009/0120114 | A1 | 5/2009 | Scarpinato | |
| 2009/0229812 | A1 * | 9/2009 | Pineo | F01M 5/00 165/297 |

FOREIGN PATENT DOCUMENTS

| | | | |
|---|---|---|---|
| CN | 1761829 | | 4/2006 |
| CN | 101435426 | A | 5/2009 |
| DE | 1149368 | | 5/1963 |
| EP | 1887266 | | 2/2008 |
| EP | 2058522 | A2 | 5/2009 |
| EP | 2058522 | | 6/2012 |
| GB | 2111662 | A | 7/1983 |
| JP | 2000346215 | A | 12/2000 |
| WO | 02070930 | | 9/2002 |
| WO | 03048575 | A1 | 6/2003 |

OTHER PUBLICATIONS

International Search Report in corresponding PCT application (i.e., PCT/US2010/021732), mailed Apr. 25, 2012 (7 pages).

Written Opinion in corresponding PCT Application (i.e., PCT/US2010/021732), mailed Apr. 25, 2012 (11 pages).

International Search Report for PCT Application No. PCT/US2010/054495), mailed Jun. 24, 2011 (3 pages).

Written Opinion for PCT Application No. PCT/US2010/054495, mailed Jun. 24, 2011 (3 pages).

CN First Office Action CN201080065661.2, Jul. 22, 2014.

English Translation CN First Office Action CN201080065661.2, Jul. 22, 2014.

Supplementary European Search Report, EP10844145.2, Oct. 5, 2015.

* cited by examiner

COMPRESSOR SYSTEM INCLUDING A FLOW AND TEMPERATURE CONTROL DEVICE

BACKGROUND

The present invention relates to compressors. More particularly, the present invention relates to a mechanism for managing the flow and temperature of lubricant in a compressor system.

A compressor system including, for example a contact-cooled rotary screw airend, injects a lubricating coolant such as oil into the compression chamber to absorb the heat created by the compression of air. The temperature of the oil must be maintained within a range to maximize its life and to minimize the formation of condensation within the compressor system. The amount and temperature of the injected oil also has an effect on the overall performance of the airend.

SUMMARY

In one construction, the invention provides a compressor system including a compressor including a gas inlet and a lubricant inlet. The compressor is operable to compress a gas and discharge a mixed flow of compressed gas and lubricant. A valve housing includes a hot lubricant inlet, a cooled lubricant inlet, and a lubricant outlet connected to the lubricant inlet of the compressor. A sleeve is disposed within the valve housing and is movable between a first position and a second position. The sleeve at least partially defines a mixing chamber and includes a first aperture in fluid communication with the hot lubricant inlet to selectively admit a hot lubricant into the mixing chamber and a second aperture in fluid communication with the cooled lubricant inlet to selectively admit a cooled lubricant into the mixing chamber. The hot lubricant and cooled lubricant mix in the mixing chamber to define a bulk lubricant that is directed to the lubricant inlet of the compressor via the lubricant outlet. A thermal element is positioned to sense a temperature and is coupled to the sleeve to move the sleeve in response to the sensed temperature. The movement of the sleeve is operable to vary the amount of hot lubricant admitted through the first aperture and to vary the amount of cooled lubricant admitted through the second aperture to control a temperature of the bulk lubricant.

In another construction, the invention provides a compressor system including a compressor including a gas inlet and a lubricant inlet. The compressor is operable to compress a gas and discharge a mixed flow of compressed gas and lubricant. A valve housing includes a hot lubricant inlet, a cooled lubricant inlet, and a lubricant outlet connected to the lubricant inlet of the compressor. A sleeve is disposed within the valve housing and at least partially defines a mixing chamber. The sleeve includes a first aperture of a first size in fluid communication with the hot lubricant inlet to selectively admit a hot lubricant into the mixing chamber. The sleeve further includes a second aperture in fluid communication with the cooled lubricant inlet to selectively admit a cooled lubricant into the mixing chamber. The second aperture is of a second size larger than the first size. The hot lubricant and cooled lubricant mix in the mixing chamber to define a bulk lubricant that is directed to the lubricant outlet. An actuator is coupled to the sleeve and is operable to move the sleeve between a first position and a second position. In the first position, the first aperture is fully open and the second aperture is fully closed such that all of the lubricant flowing into the mixing chamber flows through the first aperture and amounts to a first quantity of the lubricant. In the second position, the first aperture is closed and the second aperture is partially open such that all of the lubricant flowing into the mixing chamber flows through the second aperture and amounts to a second quantity that is about equal to the first quantity. The sleeve is further movable between the second position and a third position in which the first aperture is closed and the second aperture is fully open such that all of the lubricant flowing into the mixing chamber flows through the second aperture and amounts to a third quantity that is greater than the first quantity.

In yet another construction, the invention provides a compressor system including a compressor including a gas inlet and a lubricant inlet. The compressor is operable to compress the gas and discharge a mixed flow of compressed gas and lubricant. A valve housing includes a hot lubricant inlet, a cooled lubricant inlet, and a lubricant outlet connected to the lubricant inlet of the compressor. A sleeve is disposed within the valve housing and includes a first aperture in fluid communication with the hot lubricant inlet and a second aperture in fluid communication with the cooled lubricant inlet. The first aperture has a size that provides for the passage of a desired quantity of fluid to the lubricant outlet and the second aperture is sized to provide for the passage of an excess quantity of fluid that is greater than the desired quantity of fluid to the lubricant outlet. A thermal element is positioned to sense a temperature and is coupled to the sleeve to move the sleeve in response to the sensed temperature. The sleeve is movable between a first position and a second position. The first aperture and the second aperture cooperate to direct the desired quantity of lubricant to the lubricant outlet. The sleeve is further movable between the second position and a third position where the second aperture alone directs a quantity of lubricant to the lubricant outlet, the quantity being between the desired quantity and the excess quantity.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
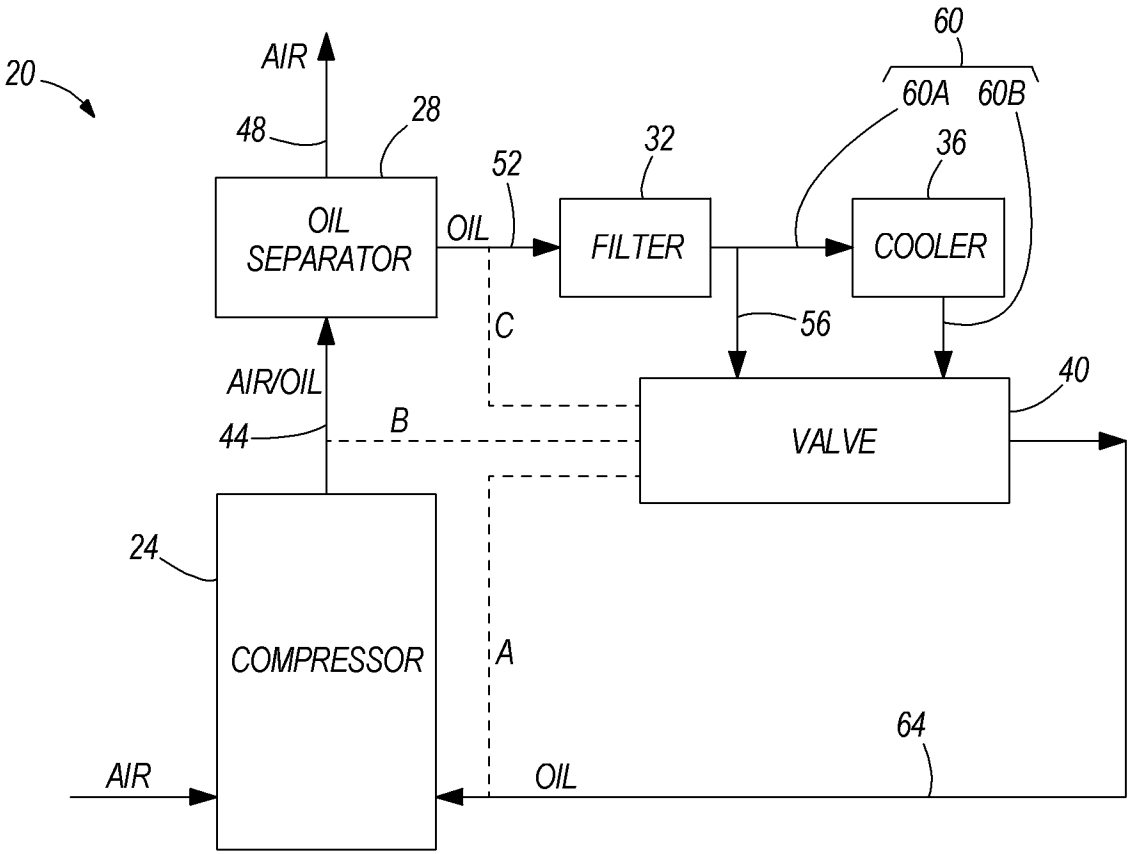
FIG. 1 is a schematic illustration of a compressor system including a flow and temperature control device.

FIG. 1 illustrates a compressor system 20 including a compressor airend (referred to herein simply as the compressor 24, an oil separator 28, a filter 32, an oil cooler 36, and a control valve 40. The compressor 24 compresses air and oil to produce an air/oil mixture having an elevated pressure compared to the air and oil supplied to the compressor 24. Although referred to throughout as "air" and "oil", the specific type of gas being compressed and the specific type of lubricating coolant injected for compression with the gas is not critical to the invention, and may vary based on the type of compressor, the intended usage, or other factors.

The air and oil compressed within the compressor 24 undergoes an increase in pressure and also temperature. The air/oil mixture is directed from the compressor 24 to the oil separator 28 along an air/oil or "compressor outlet" flow path 44 as shown in FIG. 1. The oil separator 28 separates the air/oil mixture into two separate flows, a flow of compressed air that exits the oil separator 28 along a first outlet flow path 48, and a flow of oil that exits the oil separator 28 along a second outlet flow path 52. The compressed air in the first outlet flow path 48 can be supplied to any point-of-use device or to additional processing components or assemblies (not shown) of the compressor system 20, such as a cooler, dryer, additional compressor(s), etc. The flow of oil in the second outlet flow path 52 from the oil separator 28 is directed to the filter 32, which filters the oil of contaminants before it is returned to the compressor 24.

From the filter 32, the oil can be directed along one of two separate flow paths to the control valve 40. The first flow path 56 directs oil directly from the filter 32 to the control valve 40 without cooling the oil. The second flow path 60 between the filter 32 and the control valve 40 directs oil through the oil cooler 36 that is positioned along the second flow path 60. A first portion 60A of the second flow path 60 is an oil cooler inlet flow path, and a second portion 60B of the second flow 60 is an oil cooler outlet flow path.

Figure 2:
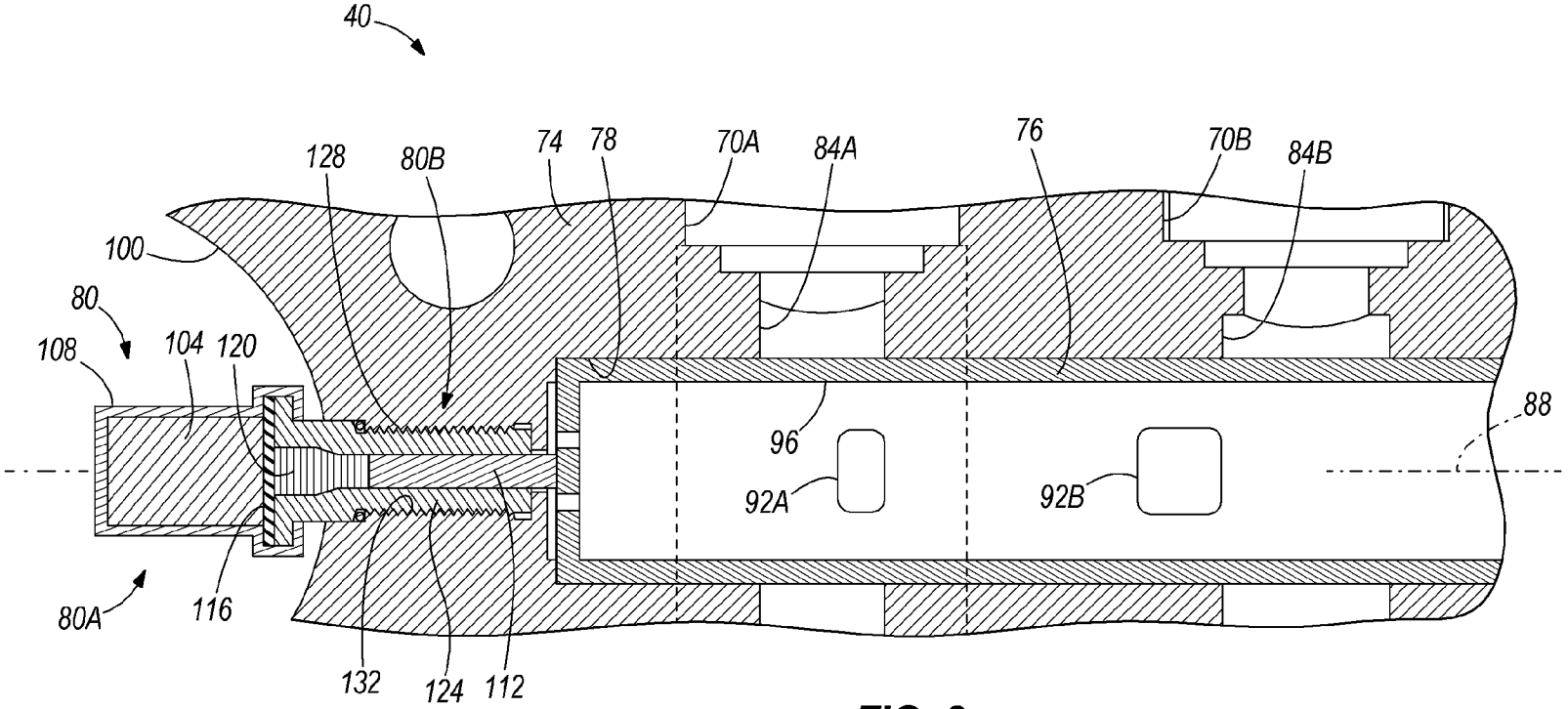
FIG. 2 is a section view of the flow and temperature control device of FIG. 1, in which a sleeve of the device is in a first position.

Both of the flow paths 56, 60 from the filter 32 lead to the control valve 40, which has a single outlet leading to an oil supply flow path 64 which supplies the oil back to the compressor 24. By selective restriction of the flow through the valve 40 from each of the flow paths 56, 60 to the valve outlet (i.e., the oil supply flow path 64), the valve 40 controls how much of the oil flowing through the filter 32 is directed through the cooler 36 and how much is passed directly from the filter 32 to the valve 40. The first outlet flow path 56 from the filter 32 is an inlet flow path to a first inlet 70A of the valve 40 (FIG. 2). The second outlet flow path 60 from the filter 32 is an inlet flow path to a second inlet 70B of the valve 40 (FIG. 2).

Figure 3:
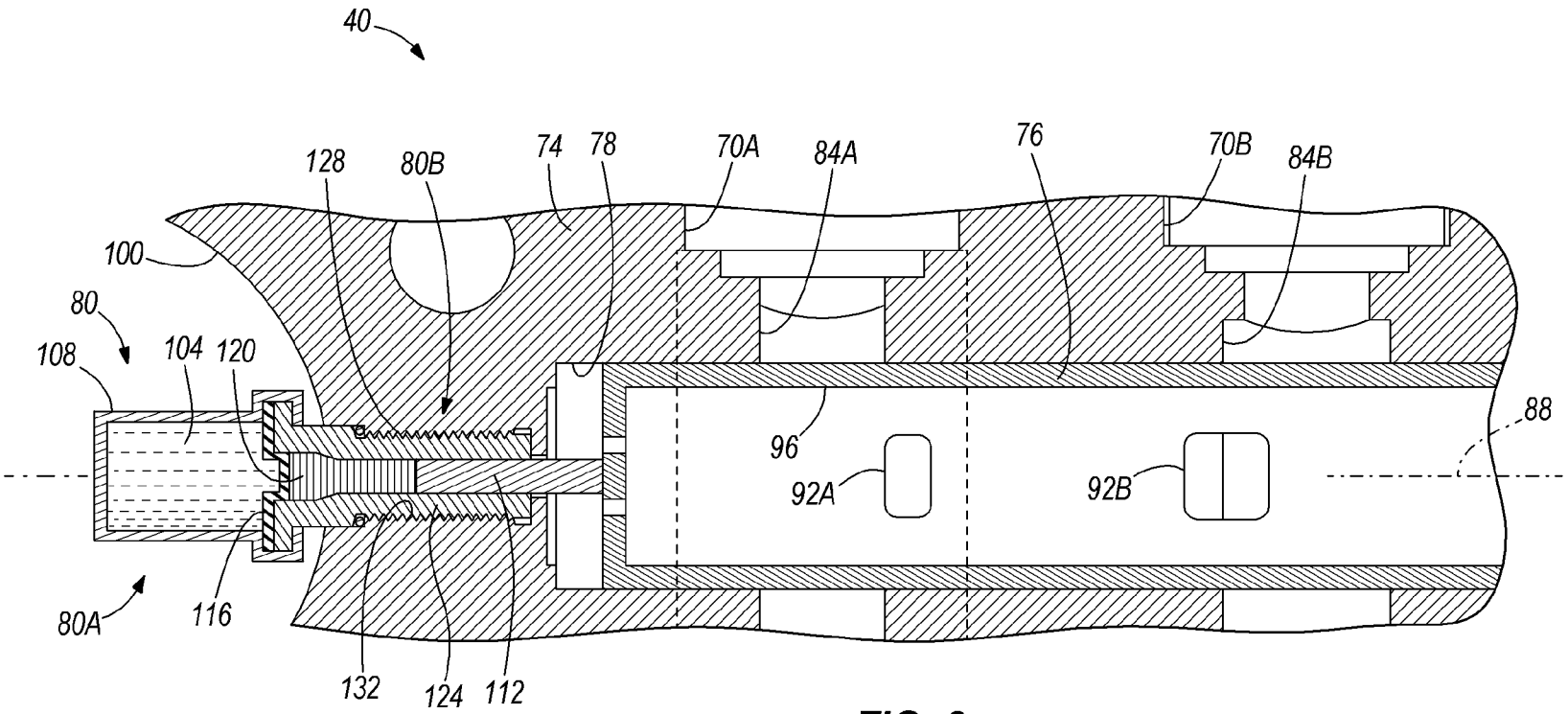
FIG. 3 is a section view of the flow and temperature control device of FIG. 1, in which the sleeve is in a second position.
Figure 4:
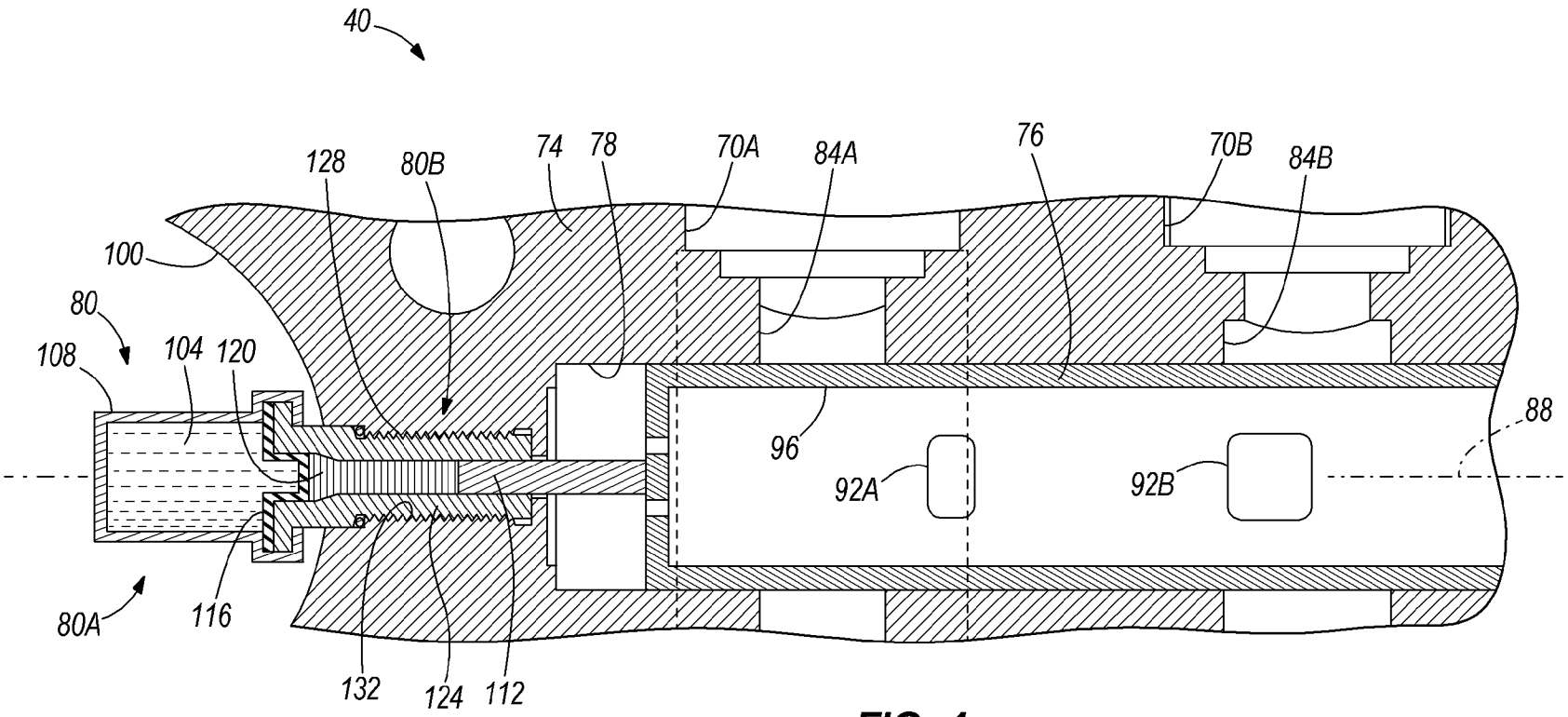
FIG. 4 is a section view of the flow and temperature control device of FIG. 1, in which the sleeve is in a third position.

As illustrated by FIGS. 2-4, the control valve 40 includes a body 74, a sleeve 76 movable within a chamber 78 formed in the body 74, and a thermal element or actuator 80 positioned at an end of the sleeve 76. The first inlet 70A of the valve 40 is in communication with a first annular passage 84A that surrounds the sleeve 76. The second inlet 70B of the valve 40 is in communication with a second annular passage 84B that surrounds the sleeve 76. The first and second annular passages 84A, 84B are spaced from each other along an axis 88 of the valve 40 defined by the chamber 78 and the sleeve 76. The sleeve 76 includes a first aperture 92A in selective communication with the first annular passage 84A and a second aperture 92B in selective communication with the second annular passage 84B. The second aperture 92B is larger than the first aperture 92A. Both of the apertures 92A, 92B are in communication with a mixing chamber 96 defined by the inside of the sleeve 76, which is substantially hollow and cylindrical in the illustrated construction. The mixing chamber 96 is in communication with the valve outlet (and thus, the oil supply flow path 64) so that all of the oil supplied to the mixing chamber 96 (whether from the first inlet 70A or the second inlet 70B, or both) is directed to the oil supply flow path 64. The oil transferred from the mixing chamber 96 to the oil supply flow path 64 through the valve outlet is referred to as the "bulk" flow of oil (or "combined" flow if oil that is received from both inlets 70A, 70B).

Although the first aperture 92A is illustrated as the only aperture for admitting oil into the mixing chamber 96 from the first inlet 70A and the second aperture 92B is illustrated as the only aperture for admitting oil into the mixing chamber 96 from the second inlet 70B, either one or both of the first and second apertures 92A, 92B can be one of a plurality of apertures spaced around the sleeve 76 to admit oil into the mixing chamber 96 from multiple angles about the respective annular passages 84A, 84B. Regardless of whether the first and second apertures 92A, 92B are the only two apertures or are each a part of a respective plurality of apertures, the functional characteristics described below are equally applicable.

Under most conditions of operation, the flow of oil to the compressor 24 should not exceed a predetermined desired flow rate for maximum performance of the compressor 24. Whenever the compressor 24 is operating at a temperature below a first predetermined set point, the sleeve 76 is in a first position as shown in FIG. 2. In the first position, the first aperture 92A is fully exposed to the first annular passage 84A and the second aperture 92B is fully blocked from communication with the second annular passage 84B. Thus, none of the flow of oil from the filter 32 is supplied to the valve 40 through the oil cooler 36. Rather, all of the flow of oil from the filter 32 to the valve 40 is provided through the first flow path 56, which is a flow path between the filter 32 and the valve 40 along which the oil is not actively cooled. The flow path may be a direct flow path between the filter 32 and the valve 40 as shown in FIG. 1. The first aperture 92A in the sleeve 76 is sized to provide a minimum required flow of oil when the sleeve 76 is in the first position. If the first aperture 92A is one of a plurality of apertures in communication with the first annular passage 84A, the plurality of apertures as a whole are sized to provide a minimum required flow of oil when the sleeve 76 is in the first position.

When the compressor 24 is operating at a temperature from the first predetermined set point up to a second predetermined set point, the sleeve 76 is gradually moved by the actuator 80 from the first position toward a second position (FIG. 3) as described in further detail below. In the second position, the second aperture 92B is partially exposed to the second annular passage 84B and the first aperture 92A is fully blocked from communication with the first annular passage 84A. Thus, none of the flow of oil from the filter 32 is supplied to the valve 40 directly through the first flow path 56. Rather, all of the flow of oil from the filter 32 to the valve 40 is provided through the second flow path 60, which directs the flow of oil through the oil cooler 36 before delivering it to the valve 40. When the sleeve 76 is in the second position, the exposed portion of the second aperture 92B in the sleeve 76 provides a flow of cooled oil about equal to the minimum required flow (i.e., about equal to the flow of oil provided through the first aperture 92A when the sleeve 76 is in the first position). During the transition between the first position and the second position, portions of both apertures 92A, 92B are exposed to the respective annular passages 84A, 84B so that a mix of "hot" oil (i.e., un-cooled by the oil cooler 36) and cooled oil is provided to the oil supply flow path 64. The remaining portions of both apertures 92A, 92B are blocked. At all times during the transition between the first position and the second position of the sleeve 76, the overall flow (i.e., "combined flow" or "bulk flow") of oil remains the same (i.e., about equal to the minimum required flow provided by the first aperture 92A in the first position) as the combined size of the portions of the apertures 92A, 92B that are exposed is about equal to the size of the first aperture 92A.

When the compressor 24 operates at a temperature above the second set point, the first aperture 92A remains closed and an increasingly greater portion of the second aperture 92B is gradually exposed to the second annular passage 84B, and thus the second inlet 70B. Thus, only cooled oil is provided to the oil supply flow path 64, similar to the sleeve 76 in the second position (FIG. 3). However, as the sleeve 76 moves from the second position (FIG. 3) toward a third position (FIG. 4), the overall flow of oil gradually increases, in excess of the minimum flow to provide additional cooling. The second aperture 92B in the sleeve 76 is sized to provide a maximum flow of cooled oil when fully open (i.e., fully exposed to the second annular passage 84B and the second inlet 70B when the sleeve 76 is in the third position). If the second aperture 92B is one of a plurality of apertures in communication with the second annular passage 84B, the plurality of apertures as a whole are sized to provide a maximum flow of cooled oil when fully open.

The actuator 80 includes a sensor portion 80A and a prime mover portion 80B. The sensor portion 80A is positioned in a chamber 100 of the valve body 74 that is remote from the chamber 78 that houses the sleeve 76. The chamber 100, and thus the sensor portion 80A of the actuator 80, is in fluid communication with the oil or the air/oil mixture. FIG. 1 illustrates three possible paths A, B, C for fluidly coupling the chamber 100 with oil or the air/oil mixture. Each of the paths A, B, C represents a potential tubing or piping conduit for fluidly coupling the chamber 100 and the sensor portion 80A with a fluid of the compressor system 20. The first path A couples the chamber 100 to the oil supply flow path 64 at a position just upstream of the compressor 24. Thus, the sensor portion 80A of the actuator 80 senses and reacts to the temperature of the oil just prior to injection into the compressor 24. The second path B couples the chamber 100 to the air/oil mixture just downstream of the compressor 24. Thus, the sensor portion 80A of the actuator 80 senses and reacts to the temperature of the air/oil mixture just after ejection from the compressor 24. The third path C couples the chamber 100 to the oil just downstream of the oil separator 28. Thus, the sensor portion 80A of the actuator 80 senses and reacts to the temperature of the oil just after separation from the compressed air/oil mixture.

In some constructions where the sensor portion 80A of the actuator 80 is fluidly coupled along path A of FIG. 1, the valve 40 may be physically coupled to the compressor 24 or positioned directly adjacent the oil inlet of the compressor 24 where the oil supply flow path 64 injects oil into the compressor 24 so that the sensor portion 80A may be positioned directly in or adjacent to the compressor's oil inlet. In some constructions where the sensor portion 80A of the actuator 80 is fluidly coupled along path B of FIG. 1, the valve 40 may be physically coupled to the compressor 24 or positioned directly adjacent the outlet of the compressor 24 where the compressed air/oil mixture is ejected from the compressor 24 to the outlet flow path 44 so that the sensor portion 80A may be positioned directly in or adjacent to the compressor's outlet. In some constructions where the sensor portion 80A of the actuator 80 is fluidly coupled along path C of FIG. 1, the valve 40 may be physically coupled to or positioned directly adjacent the outlet of the oil separator 28 or the inlet of the filter 32 so that the sensor portion 80A may be positioned directly in or adjacent to the separator outlet or the filter inlet. In other arrangements, the sensor portion 80A is remotely located and fluid is directed along one of the paths A, B, or C to the sensor portion 80A to allow the sensor portion 80A to sense the fluid temperature. The operation of the valve 40 can be calibrated to control the temperature and the flow of oil based on the use of any one of the possible paths A, B, C.

In some constructions, the actuator 80 may be a diaphragm-type thermal actuator available from Caltherm Corporation of Columbus, Ind. The sensor portion 80A of the actuator 80 can include an expansion material 104 contained within a cup 108 and configured to move the prime mover portion 80B in a predetermined linear manner within the operating temperature range of the compressor 24 (i.e., the temperature range of the oil or air/oil mixture). In some constructions, the expansion material 104 is wax which changes phase from solid to liquid within the operating temperature range of the compressor 24. The prime mover portion 80B of the actuator 80 can include a piston 112 that is coupled to a diaphragm 116 with a plug 120. The diaphragm 116 cooperates with the cup 108 to define a chamber that contains the expansion material 104. A housing or piston guide 124 of the actuator 80 at least partially encloses the piston 112 and the plug 120, and cooperates with the cup 108 to sandwich the diaphragm 116 in position. The exterior of the piston guide 124 includes male threads 128 for engaging the actuator 80 with a threaded aperture 132 of the valve body 74.

Although the actuator 80 is illustrated to include a linearly traveling prime mover portion 80B which actuates the sleeve 76 in a linear manner, a rotary type actuator can be substituted. The valve 40 can be reconfigured to selectively establish and terminate fluid communication between the inlets 70A, 70B and the apertures 92A, 92B upon rotative movement of the sleeve 76 within the chamber 78 or a transmission device can be provided to convert rotative movement to linear movement.

In some constructions, the actuator 80 may be an electromechanical actuator. In such constructions, the sensor portion 80A of the actuator 80 can be an electrical sensor configured to output an electrical signal. The prime mover portion 80B can be an electrical motor that is configured to move the sleeve 76 back and forth in a calibrated manner between the positions described above, based on the fluid temperature sensed by the sensor portion 80A. The sensor portion 80A and the prime mover portion 80B can be located remotely from each other or adjacent each other.

In operation, the valve 40 operates to control the quantity and temperature of the oil delivered to the compressor 24 to assure that the minimum and most efficient quantity of oil is delivered to the compressor 24 unless the oil temperature demands additional flow. During compressor start-up, the compressor 24 and the oil are both cold. The oil does not perform optimally at this lower temperature and it is desirable to heat the oil to a desired temperature range as quickly as possible. The valve 40 senses this low oil temperature and maintains the sleeve in the position illustrated in FIG. 2. When in this position, none of the oil passes through the oil cooler 36. Rather, the oil continues to circulate through the compressor 24, thereby heating the oil. As the oil temperature enters the optimal temperature range, the sleeve 76 begins moving to the right toward the position illustrated in FIG. 3. Before reaching the position of FIG. 3, some of the oil entering the mixing chamber 96 is cooled enough to remove an amount of heat about equal to the heat added by the compressor 24 during operation, thereby maintaining the oil within the desired range. As the load increases on the compressor 24, the sleeve 76 eventually reaches the point illustrated in FIG. 3. At this point, all of the oil must be cooled to maintain the oil within the desired temperature range and of the desired flow rate. As load increases further, the oil temperature increases above the desired range. The actuator 80 senses this temperature and moves the sleeve 76 toward the position illustrated in FIG. 4. In this position, the valve 40 admits additional cooled oil to further cool the compressor 24. Thus, the flow rate of oil to the compressor 24 only increases above the minimum predetermined amount when the oil temperature dictates that additional flow is required.

Thus, the invention provides, among other things, a compressor system 20 including a control valve 40 operable to mechanically control the temperature and the flow of oil to a compressor 24. A sleeve 76 of the valve 40 is provided with multiple apertures to provide cooled, non-cooled, or mixed oil in variable predetermined flow amounts to the compressor 24 based on a sensed condition of the compressor 24. Various features and advantages of the invention are set forth in the following claims.

What is claimed is:

1. A compressor system comprisig:

a compressor including a gas inlet and a lubricant inlet, the compressor operable to compress a gas and discharge a mixed flow of compressed gas and lubricant;

a valve housing including a hot lubricant inlet forming a first annular passageway surrounding an internal portion of the valve housing, a cooled lubricant inlet forming a second annular passageway surrounding the internal portion of the valve housing, and a lubricant outlet connected to the lubricant inlet of the compressor;

a sleeve having a length extending in an axial direction and being disposed within the valve housing and movable between a first position and a second position, the sleeve at least partially defining a mixing chamber and including a first aperture in fluid communication with the hot lubricant inlet to selectively admit a hot lubricant into the mixing chamber and a second aperture spaced axially apart from the first aperture in fluid communication with the cooled lubricant inlet to selectively admit a cooled lubricant into the mixing chamber, the hot lubricant and cooled lubricant mixing in the mixing chamber to define a bulk lubricant that is directed to the lubricant inlet of the compressor via the lubricant outlet, wherein the sleeve includes a hollow element, and wherein the mixing chamber is at least partially disposed within the hollow element; and a thermal element actuator positioned to sense a temperature the thermal element actuator coupled to the sleeve and constructed to move the sleeve in response to the sensed temperature, the movement of the sleeve being operable to vary an amount of hot lubricant ado teed through the first aperture and to vary an amount of cooled lubricant admitted through the second aperture to control a temperature of the bulk lubricant;

wherein the sleeve is movable between the first position in which the first aperture is fully open and the second aperture is fully closed such that all of the lubricant flowing into the mixing chamber amounts to a first quantity and flows through the first aperture, and the second position in which the first aperture is closed and the second aperture is partially open such that all of the lubricant flowing into the mixing chamber amounts to a second quantity that is equal to the first quantity and flows through the second aperture.

2. The compressor system of claim 1, further comprising a lubricant separator and a lubricant cooler, the lubricant separator operable to separate the mixed flow of compressed gas and lubricant into a flow of compressed gas and a flow of lubricant, at least a portion of the flow of lubricant passing through the lubricant cooler to reduce a temperature of the portion of the flow of lubricant.

3. The compressor system of claim 2, wherein the lubricant cooler includes an outlet in fluid communication with the cooled lubricant inlet such that the portion of the flow of lubricant flows through the lubricant cooler to the cooled lubricant inlet and a remainder of the flow of lubricant bypasses the lubricant cooler and flows to the hot lubricant inlet.

4. The compressor system of claim 1 wherein the hollow element is at least partially cylindrical.

5. The compressor system of claim 1, wherein the first aperture has a first size and the second aperture has a second size that is larger than the first size.

6. The compressor system of claim 1, wherein the sleeve is further movable between the second position and a third position in which the first aperture is closed and the second aperture is fully open such that all of the lubricant flowing into the mixing chamber flows through the second aperture and amounts to a third quantity that is greater than the first quantity.

7. The compressor system of claim 6, wherein the thermal element actuator expands in response to an increased sensed temperature to move the sleeve in a direction from the first position toward the second position and from the second position toward the third position.

8. The compressor system of claim 1, wherein a portion of the thermal element actuator is positioned in one of the lubricant inlet and the mixed flow of compressed gas and lubricant.

9. A compressor system comprising:

a compressor including a gas inlet and a lubricant inlet, the compressor operable to compress a gas and discharge a mixed flow of compressed gas and lubricant;

a valve housing including a hot lubricant inlet disposed completely around an inner circumferential wall of the valve housing, a cooled lubricant inlet disposed completely around the inner circumferential wall of the valve housing, and a lubricant outlet connected to the lubricant inlet of the compressor;

a sleeve disposed within the valve housing and at least partially defining a mixing chamber, the sleeve including a first aperture in fluid communication with the hot lubricant inlet to selectively admit a hot lubricant into the mixing chamber and having, a first size, and a second aperture in fluid communication with the cooled lubricant inlet to selectively admit a cooled lubricant into the mixing chamber and having a second size, the second size being larger than the first size, the hot lubricant and cooled lubricant mixing in the mixing chamber to define a bulk lubricant that is directed to the lubricant outlet;

an actuator coupled to the sleeve and operable to move the sleeve between a first position in which the first aperture is fully open and the second aperture is fully closed such that all of the lubricant flowing into the mixing chamber flows through the first aperture and amounts to a first quantity of the lubricant, and a second position in which the first aperture is closed and the second aperture is partially open such that all of the lubricant flowing into the mixing chamber flows through the second aperture and amounts to a second quantity that is equal to the first quantity, the sleeve further movable between the second position and a third position in which the first aperture is closed and the second aperture is fully open such that all of the lubricant flowing into the mixing chamber flows through the second aperture and amounts to a third quantity that is greater than the first quantity.

10. The compressor system of claim 9, further comprising a lubricant separator and a lubricant cooler, the lubricant separator operable to separate the mixed flow of compressed gas and lubricant into a flow of compressed gas and a flow of lubricant, at least a portion of the flow of lubricant passing through the lubricant cooler to reduce a temperature of the portion of the flow of lubricant.

11. The compressor system of claim 10, wherein the lubricant cooler includes an outlet in fluid communication with the cooled lubricant inlet such that the portion of the flow of lubricant flows through the lubricant cooler to the cooled lubricant inlet and a remainder of the flow of lubricant bypasses the lubricant cooler and flows to the hot lubricant inlet.

12. The compressor system of claim 9, wherein the sleeve includes a hollow cylindrical element, and wherein the mixing chamber is at least partially disposed within the hollow cylindrical element.

13. The compressor system of claim 9, wherein the actuator includes a thermal element positioned to sense a temperature and move the sleeve in response to the sensed temperature.

14. The compressor system of claim 13, wherein a portion of the thermal element is positioned in one of the lubricant inlet and the mixed flow of compressed gas and lubricant.

15. The compressor system of claim 13, wherein the thermal element expands in response to an increased sensed temperature to move the sleeve in a direction from the first position toward the second position and from the second position toward the third position.

16. The compressor system of claim 9, wherein the actuator includes a temperature sensor and a prime mover operable to move the sleeve in response to the sensed temperature.

17. The compressor system of claim 16, wherein the prime mover is an electrical motor.

18. A compressor system comprising;

a compressor including a gas inlet and a lubricant inlet, the compressor operable to compress the gas and discharge a mixed flow of compressed gas and lubricant;

a valve housing including a hot lubricant inlet surrounding a sleeve, a cooled lubricant inlet sleeve, and a lubricant outlet connected to the lubricant inlet of the compressor;

the sleeve disposed within the valve housing and including a first aperture in fluid communication with the hot lubricant inlet and a second aperture in fluid communication with the cooled lubricant inlet, the first aperture having a size that provides for the passage of a desired quantity of fluid to the lubricant outlet and the second aperture sized to provide for the passage of an excess quantity of fluid that is greater than the desired quantity of fluid to the lubricant outlet, wherein the hot lubricant inlet and the cooled lubricant inlet include portions forming a circumferential passageway around the sleeve; and a thermal element actuator positioned to sense a temperature and coupled to the sleeve to move the sleeve in response to the sensed temperature, the sleeve movable between a first position and a second position wherein the first aperture and the second aperture cooperate to direct the desired quantity of lubricant to the lubricant outlet, the sleeve further movable between the second position and a third position wherein the second aperture alone directs a quantity of lubricant to the lubricant outlet, the quantity being between the desired quantity and the excess quantity.

19. The compressor system of claim 18, further comprising a lubricant separator and a lubricant cooler, the lubricant separator operable to separate the mixed flow of compressed gas and lubricant into a flow of compressed gas and a flow of lubricant, at least a portion of the flow of lubricant passing through the lubricant cooler to reduce a temperature of the portion of the flow of lubricant.

20. The compressor system of claim 19, wherein the lubricant cooler includes an outlet in fluid communication with the cooled lubricant inlet such that the portion of the flow of lubricant flows through the lubricant cooler to the cooled lubricant inlet and a remainder of the flow of lubricant bypasses the lubricant cooler and flows to the hot lubricant inlet.

21. The compressor system of claim 18, wherein the sleeve is movable between the first position in which the first aperture is fully open and the second aperture is fully closed such that the desired quantity of lubricant flows through the first aperture to the lubricant outlet and the second position in which the first aperture is closed and the second aperture is partially open such that the desired quantity of lubricant flows through the second aperture to the lubricant outlet.

22. The compressor system of claim 21, wherein the sleeve is further movable between the second position and the third position n which the first aperture is closed and the second aperture is fully open such that the excess quantity of lubricant flows through the second aperture to the lubricant outlet.

23. The compressor system of claim 18, wherein a portion of the thermal element is positioned in one of the lubricant inlet and the mixed flow of compressed gas and lubricant.

24. The compressor system of claim 18, wherein the thermal element expands in response to an increased sensed temperature to move the sleeve in a direction from the first position toward the second position and from the second position toward the third position.

* * * * *